US012305381B1

(12) United States Patent
Mehrabi et al.

(10) Patent No.: US 12,305,381 B1
(45) Date of Patent: May 20, 2025

(54) CONNECTION OF PRECAST CONCRETE PANELS AND WALLS USING NEAR SURFACE MOUNTED BARS

(71) Applicants: Armin Barzegar Mehrabi, Miami, FL (US); Isabella Zapata Vivas, Miami, FL (US); Seyed Saman Khedmatgozar Dolati, Miami, FL (US)

(72) Inventors: Armin Barzegar Mehrabi, Miami, FL (US); Isabella Zapata Vivas, Miami, FL (US); Seyed Saman Khedmatgozar Dolati, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 18/763,482

(22) Filed: Jul. 3, 2024

(51) Int. Cl.
*E04B 1/04* (2006.01)
*E04B 1/38* (2006.01)
*E04C 5/16* (2006.01)

(52) U.S. Cl.
CPC ..... *E04B 1/043* (2013.01); *E04B 1/383* (2013.01); *E04C 5/16* (2013.01)

(58) Field of Classification Search
CPC ..... E04B 1/043; E04B 1/046; E04C 5/16
See application file for complete search history.

(56) References Cited

U.S. PATENT DOCUMENTS 1,236,387 A * 8/1917 Moore ..... E04B 5/023 52/600
4,050,211 A * 9/1977 Wahman ..... E02D 5/523 403/294
4,290,246 A * 9/1981 Hilsey ..... E04H 3/00 D25/19
4,727,701 A * 3/1988 Figari ..... E04B 5/263 52/483.1
4,836,717 A * 6/1989 Landaeus ..... E02D 5/523 403/294
5,678,372 A * 10/1997 Thomson ..... E04B 1/0007 52/287.1
6,131,350 A * 10/2000 Sanders ..... E02D 27/02 52/294
6,345,927 B1 * 2/2002 Pao ..... G21C 13/087 403/294
9,347,195 B2 * 5/2016 Whitty, Sr. ..... E02D 27/12
11,319,689 B1 * 5/2022 Mehrabi ..... E02D 5/526
11,319,706 B1 * 5/2022 Khedmatgozar Dolati ..... E04C 3/36

(Continued)

FOREIGN PATENT DOCUMENTS

CN 103821264 A * 5/2014 ..... E04B 1/046
CN 117248654 A * 12/2023

(Continued)

*Primary Examiner* — Babajide A Demuren

(74) *Attorney, Agent, or Firm* — SALIWANCHIK, LLOYD & EISENSCHENK

(57) ABSTRACT

Systems and methods for connection between precast concrete elements are provided. Near-surface mounting bars (NSMBs) can be used to connect panel elements (e.g., decks and/or slabs), concrete walls, retaining walls, and/or abutments. A straight or butt connection can be used for panel and wall elements, and a staggered or lap connection can be used for panel elements. The connection systems offer new ways for connecting precast concrete walls and deck panels.

12 Claims, 3 Drawing Sheets

(56) References Cited

U.S. PATENT DOCUMENTS

| | | | | |
|---|---|---|---|---|
| 11,655,605 | B2 * | 5/2023 | Zong | E02D 5/526 405/251 |
| 11,828,033 | B1 * | 11/2023 | Khedmatgozar Dolati | E02D 5/526 |
| 2005/0220539 | A1 * | 10/2005 | Yee | E04B 5/04 404/40 |
| 2012/0017520 | A1 * | 1/2012 | Hur | E04H 9/021 52/79.11 |

FOREIGN PATENT DOCUMENTS

| | | | | |
|---|---|---|---|---|
| DE | 202015104966 | U1 * | 12/2016 | E04B 1/04 |
| GB | 2115467 | A * | 9/1983 | E02D 5/523 |

* cited by examiner

CONNECTION OF PRECAST CONCRETE PANELS AND WALLS USING NEAR SURFACE MOUNTED BARS

BACKGROUND

Precast concrete elements are widely used in the construction industry. These elements are typically fabricated in a precast plant and then transported to the construction site for assembly. The maximum dimensions for each element are typically limited by shipping and handling requirements.

BRIEF SUMMARY

Embodiments of the subject invention provide novel and advantageous systems and methods for connection between precast concrete elements. Near-surface mounting bars (NSMBs) can be used to connect panel elements (e.g., decks and/or slabs), concrete walls, retaining walls, and/or abutments. A straight or butt connection can be used for panel and wall elements, and a staggered or lap connection can be used for panel elements. The connection systems and methods are different from related art systems and methods for joining separate precast concrete panels or walls, and therefore offer completely new ways for connecting precast concrete walls and deck panels.

In an embodiment, a method for connecting precast concrete elements can comprise: providing or casting a first precast concrete element, the first precast concrete element having a first connection end configured to connect to a second precast concrete element, and the first precast concrete element further having first grooves formed on a first surface of the first precast concrete element and on a second surface of the first precast concrete element opposite from the first surface; providing or casting the second precast concrete element, the second precast concrete element having a second connection end configured to connect to the first connection of the first precast concrete element, and the second precast concrete element further having second grooves formed on a third surface of the second precast concrete element and on a fourth surface of the second precast concrete element opposite from the third surface; applying a first adhesive to at least one of the first connection end of the first precast concrete element and the second connection end of the second precast concrete element (i.e., to the first connection end, the second connection end, or both); disposing the first precast concrete element near the second precast concrete element such that the first connection end is adjacent to the second connection end and the first grooves align with the second grooves, the first grooves and the second grooves forming a plurality of third grooves such that each third groove comprises one first groove and one second groove aligned with the respective one first groove; applying pressure such that the first connection end and the second connection end are pushed towards each other; disposing a plurality of NSMBs in the plurality of third grooves, respectively; and applying a second adhesive (which can be the same as or different from the first adhesive) to the third grooves having the NSMBs disposed therein. Each of the first precast concrete element and the second precast concrete element can be a panel element; alternatively, each of the first precast concrete element and the second precast concrete element can be a wall element. Each NSMB can comprise, for example, carbon fiber reinforced polymer (CFRP), though embodiments are not limited thereto. The first adhesive can comprise, for example, a first grout (e.g., a first epoxy grout); and/or the second adhesive can comprise, for example, a second grout (e.g., a first epoxy grout) that can be the same as or different from the first grout. The method can further comprise, before applying the first adhesive, transporting the first precast concrete element and the second precast concrete element to a location where they will be used in a construction structure (from the location where they were cast). The method can further comprise, after applying the second adhesive, allowing the second adhesive to cure before applying any load to the connected first precast concrete element and second precast concrete element. The first and second surfaces can be top and bottom surfaces, respectively, and the third and fourth surfaces can be top and bottom surfaces, respectively (e.g., when each of the first precast concrete element and the second precast concrete element is a panel element). The first and second surfaces can be first side and second side surfaces, respectively, and the third and fourth surfaces can be third side and fourth side surfaces, respectively (e.g., when each of the first precast concrete element and the second precast concrete element is a wall element). The length and width of the NSMBs can be configured to fit snugly in the third grooves (e.g., the length of each NSMB can be in a range of from 90% to 99.9% of the length of each third groove, and/or the width of each NSMB can be in a range of from 90% to 99.9% of the width of each third groove). The first connection end can be a first butt end; the second connection end can be a second butt end; the first precast concrete element can be a male precast concrete element; and the second precast concrete element can be a female precast concrete element. The first butt end can be a male hexagonal butt end; and the second butt end can be a female hexagonal butt end. Alternatively, the first precast concrete element can comprise a first main body and a first overhang segment extending a first length from the first main body at the first connection end; the second precast concrete element can comprise a second main body and a second overhang segment extending a second length (that is the same as or about the same as the first length) from the second main body at the second connection end. The first precast concrete element can have a first thickness; the second precast concrete element can have a second thickness; the first overhang segment can have a third thickness that is half (or about half) of the first thickness; and the second overhang segment can have a fourth thickness that is half (or about half) of the second thickness. The first adhesive can be applied to the underside of the first overhang segment (i.e., the side not having the first grooves), the underside of the second overhang segment (i.e., the side not having the second grooves), or both.

In another embodiment, a system for connecting precast concrete elements can comprise: a first precast concrete element, the first precast concrete element having a first connection end configured to connect to a second precast concrete element, and the first precast concrete element further having first grooves formed on a first surface of the first precast concrete element and on a second surface of the first precast concrete element opposite from the first surface; the second precast concrete element, the second precast concrete element having a second connection end configured to connect to the first connection of the first precast concrete element, and the second precast concrete element further having second grooves formed on a third surface of the second precast concrete element and on a fourth surface of the second precast concrete element opposite from the third surface; a first adhesive configured to be applied to at least one of the first connection end of the first precast concrete element and the second connection end of the second precast concrete element; a plurality of NSMBs; and a second adhesive (that can be the same as or different from the first adhesive). The first precast concrete element and the second precast concrete element can be configured such that, when the first connection end is disposed adjacent to the second connection end, the first grooves align with the second grooves to form a plurality of third grooves such that each third groove comprises one first groove and one second groove aligned with the respective one first groove. The plurality of NSMBs can be configured to be disposed in the plurality of third grooves, respectively. The second adhesive can be configured to be applied to the third grooves after the NSBMs are respectively disposed therein. Each of the first precast concrete element and the second precast concrete element can be a panel element; alternatively, each of the first precast concrete element and the second precast concrete element can be a wall element. Each NSMB can comprise, for example, carbon fiber reinforced polymer (CFRP), though embodiments are not limited thereto. The first adhesive can comprise, for example, a first grout (e.g., a first epoxy grout); and/or the second adhesive can comprise, for example, a second grout (e.g., a first epoxy grout) that can be the same as or different from the first grout. The first and second surfaces can be top and bottom surfaces, respectively, and the third and fourth surfaces can be top and bottom surfaces, respectively (e.g., when each of the first precast concrete element and the second precast concrete element is a panel element). The first and second surfaces can be first side and second side surfaces, respectively, and the third and fourth surfaces can be third side and fourth side surfaces, respectively (e.g., when each of the first precast concrete element and the second precast concrete element is a wall element). The length and width of the NSMBs can be configured to fit snugly in the third grooves (e.g., the length of each NSMB can be in a range of from 90% to 99.9% of the length of each third groove, and/or the width of each NSMB can be in a range of from 90% to 99.9% of the width of each third groove). The first connection end can be a first butt end; the second connection end can be a second butt end; the first precast concrete element can be a male precast concrete element; and the second precast concrete element can be a female precast concrete element. The first butt end can be a male hexagonal butt end; and the second butt end can be a female hexagonal butt end. Alternatively, the first precast concrete element can comprise a first main body and a first overhang segment extending a first length from the first main body at the first connection end; the second precast concrete element can comprise a second main body and a second overhang segment extending a second length (that is the same as or about the same as the first length) from the second main body at the second connection end. The first precast concrete element can have a first thickness; the second precast concrete element can have a second thickness; the first overhang segment can have a third thickness that is half (or about half) of the first thickness; and the second overhang segment can have a fourth thickness that is half (or about half) of the second thickness. The first adhesive can be configured to be applied to the underside of the first overhang segment (i.e., the side not having the first grooves), the underside of the second overhang segment (i.e., the side not having the second grooves), or both.

BRIEF DESCRIPTION OF DRAWINGS

FIG. 1(*a*) shows casting of male and female precast panels; FIG. 1(*b*) shows aligning of the panels next to each other (male-to-female); FIG. 1(*c*) shows placing near-surface mounting bars (NSMBs) in the grooves of the panels; and FIG. 1(*d*) shows the final product (e.g., after pouring of adhesive/grout material for the NSMBs).

FIG. 2(*a*) shows casting of deck or slab panels; FIG. 2(*b*) shows connecting both elements while staggering one on top of the other; FIG. 2(*c*) shows placing NSMBs in the grooves of the panels; and FIG. 2(*d*) shows the final product (e.g., after pouring of adhesive/grout material for the NSMBs).

FIG. 3(*a*) shows casting male and female precast wall elements; FIG. 3(*b*) shows aligning of the wall elements next to each other (male-to-female); FIG. 3(*c*) shows placing NSMBs in the grooves of the wall elements; and FIG. 3(*d*) shows the final product (e.g., after pouring of adhesive/grout material for the NSMBs).

DETAILED DESCRIPTION

Embodiments of the subject invention provide novel and advantageous systems and methods for connection between precast concrete elements. Near-surface mounting bars (NSMBs) can be used to connect panel elements (e.g., decks and/or slabs), concrete walls, retaining walls, and/or abutments. A straight or butt connection can be used for panel and wall elements, and a staggered or lap connection can be used for panel elements. The connection systems and methods are different from related art systems and methods for joining separate precast concrete panels or walls, and therefore offer completely new ways for connecting precast concrete walls and deck panels.

Because the dimensions for precast elements are limited by shipping and handling requirements, connecting two or more precast elements on-site is required/desirable. Connection methods between wall precast elements include using mechanical connections (bolts, dowels, or embedded connectors), adhesives, or grouts. These types of connections are designed to provide structural performance, prevent or inhibit displacement, and provide load transfer between adjacent panels. Full-depth deck joints with diamond shear key type and ultra-high performance concrete (UHPC) are the most commonly used joints in precast deck panels. However, UHPC can have some constructability and cost challenges. The connection between precast concrete elements plays an important role in ensuring the overall performance of the structure. Embodiments of the subject invention provide novel and improved connection systems and methods to improve the performance and efficiency of precast elements.

NSMBs can be applied to strengthen existing reinforced concrete elements and masonry structures. NSMBs for concrete elements can be applied for flexural strengthening (see also, e.g., Dolati, NSM FRP Pile-Splice System for Prestressed Precast Concrete Piles, Pract. Period. Struct. Des. Constr., vol. 27, no. 4, p. 04022046, November 2022, doi: 10.1061/(ASCE)SC.1943-5576.0000723; which is hereby incorporated by reference herein in its entirety). NSM systems can be used for connecting/splicing precast concrete piles. Embodiments of the subject invention use NSMBs for connecting precast concrete elements including walls and panels (e.g., deck panels and slab panels). The connections provide advantageous systems for connecting precast concrete elements.

The joint geometry and connection type between precast concrete elements have an important role in the successful construction and long-term performance of the precast elements. The application of NSMBs can be used not only for connecting these precast elements but also for increasing strength capacity, providing an effective connection system between precast concrete elements. A straight or butt NSMB connection system/method can be used for panel and wall elements, and a staggered or lap NSMB connection system/method can also be used for panel elements.

Figures 1A, 1B, 1C, 1D:
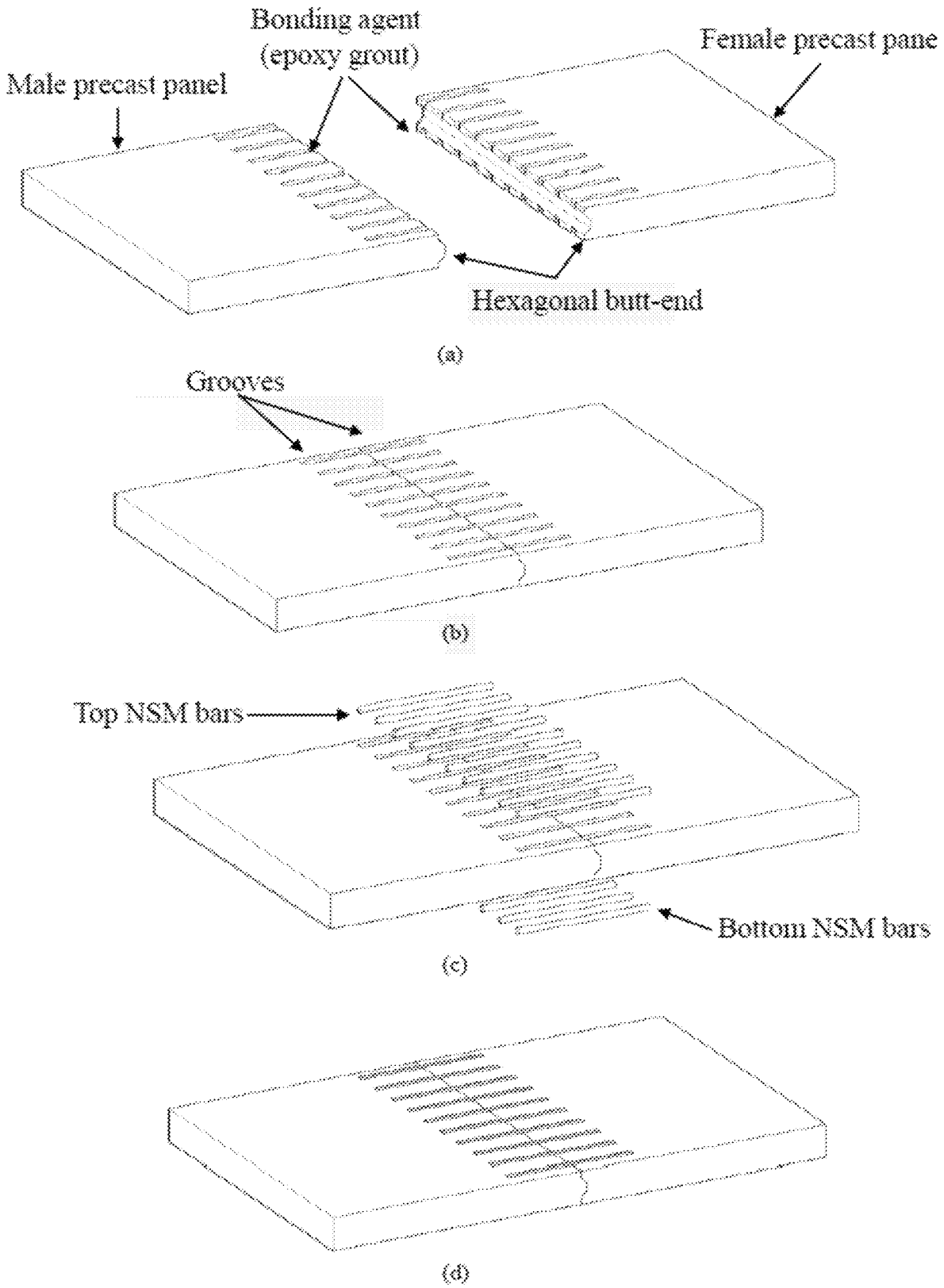
FIGS. 1(*a*)-1(*d*) show schematic views of a system/method for connection between precast concrete elements, according to an embodiment of the subject invention. These figures show butt connection for deck elements.

FIGS. 1(*a*)-1(*d*) show schematic views of a system/method for connection between precast concrete elements, according to an embodiment of the subject invention. These figures show butt (or straight) connection for deck/panel elements. The butt connection can include precast concrete elements with a butt end (e.g., a hexagonal butt end). This type of connection requires a male panel and a female panel, as shown in FIG. 1(*a*). Each panel can include grooves on the top surface and/or the bottom surface of the respective element on the butt-end side. The grooves on the male panel can line up with those on the female panel, such that the panels are configured to have NSMBs disposed in the grooves to help connect the panels to each other (see also FIGS. 1(*b*)-1(*d*)).

The system/method can include: selecting the desired/required thickness for the precast elements and then casting the male and female panels (e.g., deck or slab panels) with a butt end (e.g., a hexagonal butt end), with the grooves on top and bottom of each panel on the butt-end side, as shown in FIG. 1(*a*); selecting the NSMBs for connecting the precast elements and defining the length and depth of the grooves; transporting the elements to the desired location and placing the panels next to each other, as shown in FIG. 1(*b*), where each connection includes a male precast panel and a female precast panel (male-to-female connection); applying an adhesive (e.g., grout, such as epoxy grout) on at least one of the male butt-end surface and the female butt-end surface (i.e., on the male and/or female connection surface(s)); aligning the grooves on each panel and applying pressure at the connecting surface; placing the NSMBs inside the grooves on both the top and bottom surfaces, as shown in FIG. 1(*c*); establishing the connection by pouring/applying adhesive/grout materials to seal the grooves both at the top and bottom surfaces (FIG. 1(*d*)); and/or allowing curing of the adhesive/grout before applying any load.

Figures 2A, 2B, 2C, 2D:
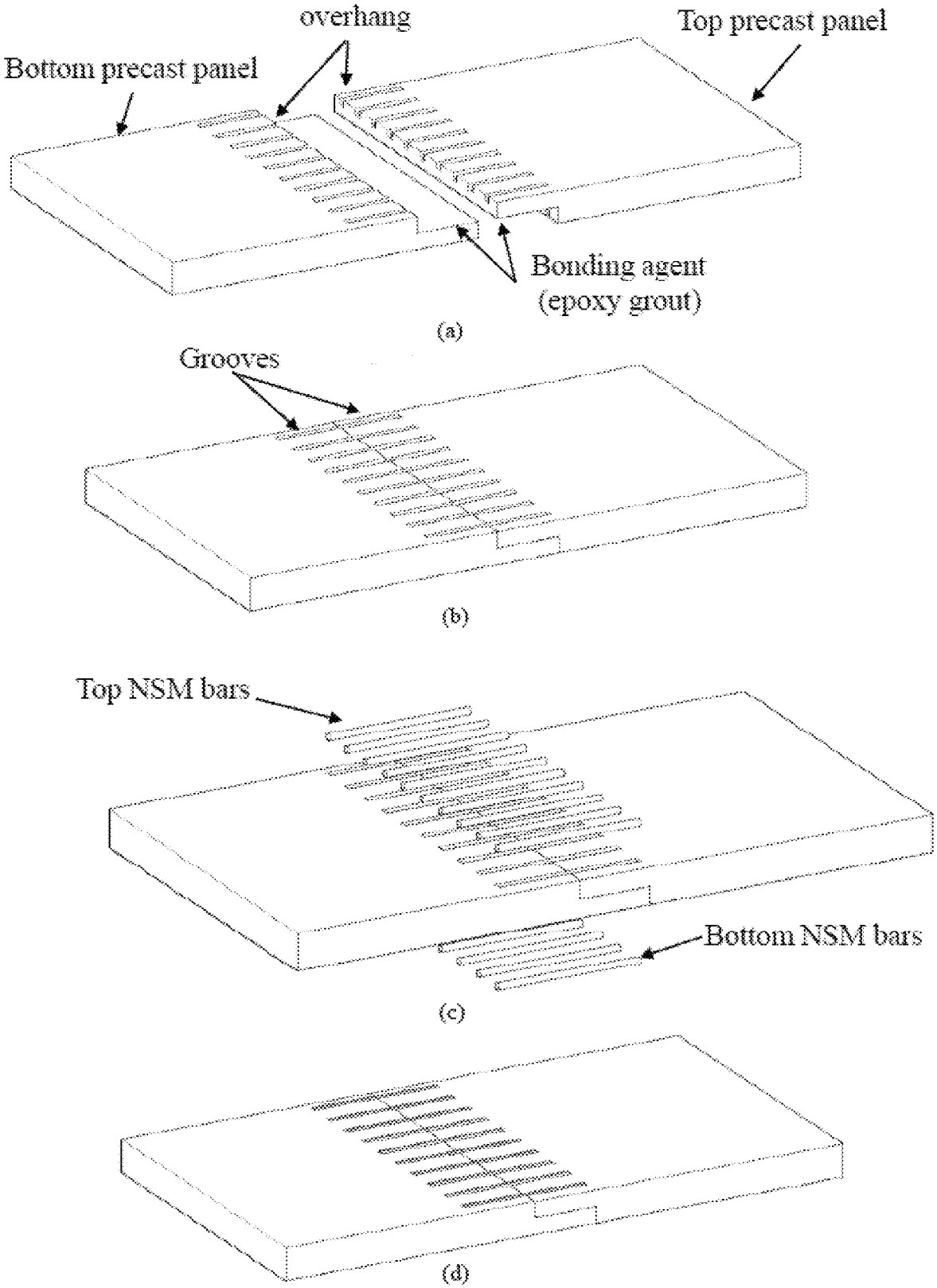
FIGS. 2(*a*)-2(*d*) show schematic views of a system/method for connection between precast concrete elements, according to an embodiment of the subject invention. These figures show butt connection for deck elements.

FIGS. 2(*a*)-2(*d*) show schematic views of a system/method for connection between precast concrete elements, according to an embodiment of the subject invention. These figures show another type of connection for panel elements, which is a staggered or lap connection. A lap connection for deck or slab panels includes precast elements each having an overhang. The length of the overhang segment should be designed to be comparable to the splice length of the NSMB(s), and should have a thickness of half (or about half) of the thickness of the deck or slab panel, as shown in FIG. 2(*a*). Each panel can include grooves on the top surface and/or the bottom surface of the respective element on the connection side. The grooves on the first panel can line up with those on the second panel, such that the panels are configured to have NSMBs disposed in the grooves to help connect the panels to each other (see also FIGS. 2(*b*)-2(*d*)).

The system/method can include: selecting the desired/required thickness for the precast elements and then casting the panels each having the overhang segment, as shown in FIG. 2(*a*); selecting the NSMBs for connecting the precast elements and defining the length and depth of the grooves; transporting the elements to the desired location and applying an adhesive (e.g., grout, such as epoxy grout) on at least one of the connection surfaces (i.e., on the connection surface of the first panel and/or the connection surface of the second panel); placing the panels on top of each other, aligning the overhang segments and the grooves, as shown in FIG. 2(*b*); placing the bars inside the grooves on the top and bottom surfaces of the panels, as shown FIG. 2(*c*); establishing the connection by pouring/applying adhesive/grout materials to seal the grooves both at the top and bottom surfaces, as shown in FIG. 2(*d*); and/or allowing curing of the adhesive/grout before applying any load.

Figures 3A, 3B, 3C, 3D:
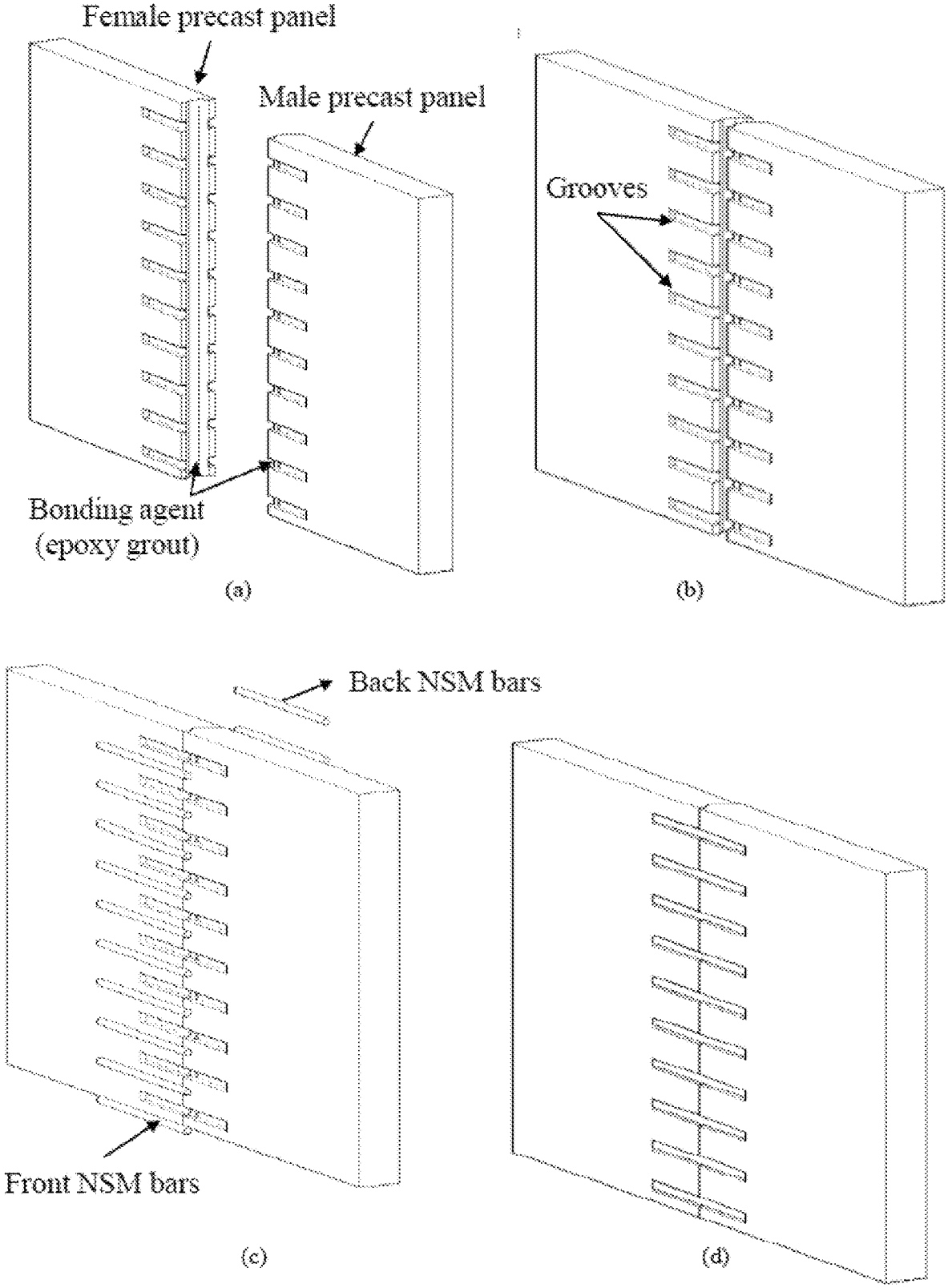
FIGS. 3(*a*)-3(*d*) show schematic views of a system/method for connection between precast concrete elements, according to an embodiment of the subject invention. These figures show butt connection for wall elements.

FIGS. 3(*a*)-3(*d*) show schematic views of a system/method for connection between precast concrete elements, according to an embodiment of the subject invention. These figures show butt connection for wall elements, similar to the butt connection for panel elements (from FIGS. 1(*a*)-1(*d*).

The system/method can include: selecting the desired/required thickness for the precast elements and then casting the male and female wall elements with a butt end (e.g., a hexagonal butt end) with the grooves on both sides of each wall element, as shown in FIG. 3(*a*); selecting the NSMBs for connecting the precast elements and defining the length and depth of the grooves; transporting the elements to the desired location and placing the elements next to each other, as shown in FIG. 3(*b*), where each connection includes a male precast wall element and a female precast wall element (male-to-female connection); applying an adhesive (e.g., grout, such as epoxy grout) on at least one of the male butt-end surface and the female butt-end surface (i.e., on the male and/or female connection surface(s)); aligning the grooves on each panel and applying pressure at the connecting surface; placing the NSMBs inside the grooves on both sides of the wall elements, as shown in FIG. 3(*c*); establishing the connection by pouring/applying adhesive/grout materials to seal the grooves on both sides of the wall elements (FIG. 3(*d*)); and/or allowing curing of the adhesive/grout before applying any load.

Embodiments of the subject invention can enhance the operation of the construction industry when it comes to splicing precast walls and panels, as well as significantly improving the strength and durability of spliced precast segments. The durability of walls and panel splices in marine and corrosive environments can also be increased remarkably. Embodiments of the subject invention can have an impact in the construction and assembly of precast elements (e.g., deck/panel elements and wall elements), making it time-effective and cost-effective, and at the same time, improving the structural performance of the precast elements.

The connection between precast concrete elements play an important role in the overall performance of a concrete structure. The connection systems and methods of embodiments of the subject invention present advantageous alternatives to related art systems, improving the performance and efficiency of connection of the precast concrete wall elements and panel elements. The use of NSMBs allows the application of prefabricated/precast concrete wall elements and panel elements in structures, thereby helping to reduce the construction time at the site, increase safety, and improve the quality because of the use of precast elements. In comparison to related art connection systems for precast wall and panel concrete elements, the simplicity of the details and installation of embodiments of the subject invention makes them labor-friendly and time-effective. Embodiments of the subject invention can omit the use of additional concrete mix at the connection of precast concrete wall elements and panel elements, in contrast with related art closure joints, contributing to the speed and cost effectiveness. Embodiments of the subject invention allow the use of any type of material for NSMBs, especially materials with higher strength and durability. For example, carbon fiber reinforced polymer (CFRP) can be used as the NSMB material and can help reduce the bar sizes with its outstanding strength and increase the durability of the connection and the structure with its corrosion resistant properties. In addition, the NSMB connection of embodiments of the subject invention can be easier to inspect compared to related art connection types.

When ranges are used herein, combinations and subcombinations of ranges (including any value or subrange contained therein) are intended to be explicitly included. When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to embodiments of the invention.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A method for connecting precast concrete elements, the method comprising:

casting a first precast concrete element, the first precast concrete element having a first connection end configured to connect to a second precast concrete element, and the first precast concrete element further having first grooves formed on a first surface of the first precast concrete element and on a second surface of the first precast concrete element opposite from the first surface;

casting the second precast concrete element, the second precast concrete element having a second connection end configured to connect to the first connection of the first precast concrete element, and the second precast concrete element further having second grooves formed on a third surface of the second precast concrete element and on a fourth surface of the second precast concrete element opposite from the third surface;

applying a first adhesive to at least one of the first connection end of the first precast concrete element and the second connection end of the second precast concrete element;

disposing the first precast concrete element near the second precast concrete element such that the first connection end is adjacent to the second connection end and the first grooves align with the second grooves, the first grooves and the second grooves forming a plurality of third grooves such that each third groove comprises one first groove and one second groove aligned with the respective one first groove;

applying pressure such that the first connection end and the second connection end are pushed towards each other;

disposing a plurality of near-surface mounting bars (NSMBs) in the plurality of third grooves, respectively; and applying a second adhesive to the third grooves, each of the first precast concrete element and the second precast concrete element being either: a) a panel element; or b) a wall element, the first connection end being a male hexagonal butt end, the second connection end being a female hexagonal butt end, the first precast concrete element further having a fifth surface connecting the first surface and the second surface, and a sixth surface opposite from the fifth surface and connecting the first surface and the second surface, the second precast concrete element further having a seventh surface connecting the third surface and the fourth surface and an eighth surface opposite from the seventh surface and connecting the third surface and the fourth surface, the first connection end of the first precast concrete being connected to both the fifth surface and the sixth surface of the first precast concrete element the second connection end of the second precast concrete being coned to both the seventh surface and the eighth surface of the second precast concrete element the fifth surface and the sixth surface of the first precast concrete element both being free of any grooves, and the seventh surface and the eighth surface of the second precast concrete element both being free of any grooves.

2. The method according to claim 1, each of the first precast concrete element and the second precast concrete element being a panel element.

3. The method according to claim 1, each of the first precast concrete element and the second precast concrete element being a wall element.

4. The method according to claim 1, each NSMB comprising carbon fiber reinforced polymer (CFRP).

5. The method according to claim 1, the first adhesive comprising a first grout, and the second adhesive comprising a second grout.

6. The method according to claim 1, further comprising:

before applying the first adhesive, transporting the first precast concrete element and the second precast concrete element to a location where they will be used in a construction structure.

7. The method according to claim 1, further comprising:

after applying the second adhesive, allowing the second adhesive to cure before applying any load to the connected first precast concrete element and second precast concrete element.

8. A system for connecting precast concrete elements, the system comprising:

a first precast concrete element, the first precast concrete element having a first connection end configured to connect to a second precast concrete element, and the first precast concrete element further having first grooves formed on a first surface of the first precast concrete element and on a second surface of the first precast concrete element opposite from the first surface;

the second precast concrete element, the second precast concrete element having a second connection end configured to connect to the first connection of the first precast concrete element, and the second precast concrete element further having second grooves formed on a third surface of the second precast concrete element and on a fourth surface of the second precast concrete element opposite from the third surface;

a first adhesive configured to be applied to at least one of the first connection end of the first precast concrete element and the second connection end of the second precast concrete element;

a plurality of near-surface mounting bars (NSMBs); and a second adhesive, the first precast concrete element and the second precast concrete element being configured such that, when the first connection end is disposed adjacent to the second connection end, the first grooves align with the second grooves to form a plurality of third grooves such that each third groove comprises one first groove and one second groove aligned with the respective one first groove, the plurality of NSMBs being configured to be disposed in the plurality of third grooves, respectively, the second adhesive being configured to be applied to the third grooves after the NSBMs are respectively disposed therein, each of the first precast concrete element and the second precast concrete element being either: a) a panel element; or b) a wall element, the first connection end being a male hexagonal butt end, the second connection end being a female hexagonal butt end, the first precast concrete element further having a fifth surface connecting the first surface and the second surface, and a sixth surface opposite from the fifth surface and connecting the first surface and the second surface, the second recast concrete element further having a seventh surface connecting the third surface and the fourth surface and an eighth surface opposite from the seventh surface and connecting the third surface and the fourth surface, the first connection end of the first precast concrete being connected to both the fifth surface and the sixth surface of the first precast concrete element, the second connection end of the second precast concrete being connected to both the seventh surface and the eighth surface of the second precast concrete element, the fifth surface and the sixth surface of the first precast concrete element both being free of any grooves, and the seventh surface and the eighth surface of the second precast concrete element both being free of any grooves.

9. The system according to claim 8, each of the first precast concrete element and the second precast concrete element being a panel element.

10. The system according to claim 8, each of the first precast concrete element and the second precast concrete element being a wall element.

11. The system according to claim 8, each NSMB comprising carbon fiber reinforced polymer (CFRP).

12. A method for connecting precast concrete elements, the method comprising:

casting a first precast concrete element, the first precast concrete element having a first connection end configured to connect to a second precast concrete element, and the first precast concrete element further having first grooves formed on a first surface of the first precast concrete element and on a second surface of the first precast concrete element opposite from the first surface;

casting the second precast concrete element, the second precast concrete element having a second connection end configured to connect to the first connection of the first precast concrete element, and the second precast concrete element further having second grooves formed on a third surface of the second precast concrete element and on a fourth surface of the second precast concrete element opposite from the third surface;

transporting the first precast concrete element and the second precast concrete element to a location where they will be used in a construction structure after transporting the first precast concrete element and the second precast concrete element to the location, applying a first adhesive to at least one of the first connection end of the first precast concrete element and the second connection end of the second precast concrete element;

disposing the first precast concrete element near the second precast concrete element such that the first connection end is adjacent to the second connection end and the first grooves align with the second grooves, the first grooves and the second grooves forming a plurality of third grooves such that each third groove comprises one first groove and one second groove aligned with the respective one first groove;

applying pressure such that the first connection end and the second connection end are pushed towards each other;

disposing a plurality of near-surface mounting bars (NSMBs) in the plurality of third grooves, respectively;

applying a second adhesive to the third grooves; and allowing the second adhesive to cure before applying any load to the connected first precast concrete element and second precast concrete element, the first connection end being a first butt end, the second connection end being a second butt end, the first precast concrete element being a male precast concrete element, the second precast concrete element being a female precast concrete element, the first butt end being a male hexagonal butt end, the second butt end being a female hexagonal butt end, each of the first precast concrete element and the second precast concrete element being either: a) a panel element; or b) a wall element, the first precast concrete element further having a fifth surface connecting the first surface and the second surface and a sixth surface opposite from the fifth surface and connecting the first surface and the second surface, the second precast concrete element further having a seventh surface connecting the third surface and the fourth surface and an eighth surface opposite from the seventh surface and connecting the third surface and the fourth surface, the first connection end of the first precast concrete being connected to both the fifth surface and the sixth surface of the first precast concrete element the second connection end of the second precast concrete being connected to both the seventh surface and the eighth surface of the second precast concrete element, the fifth surface and the sixth surface of the first recast concrete element both being free of any grooves and the seventh surface and the eighth surface of the second precast concrete element both being free of any grooves.

* * * * *